US007826727B2

(12) United States Patent
Bourne

(10) Patent No.: US 7,826,727 B2
(45) Date of Patent: Nov. 2, 2010

(54) ELECTRIC FIREPLACE

(75) Inventor: William Scott Bourne, Boynton Beach, FL (US)

(73) Assignee: Twin-Star International, Inc., Delray Beach, FL (US)

( * ) Notice: Subject to any disclaimer, the term of this patent is extended or adjusted under 35 U.S.C. 154(b) by 675 days.

(21) Appl. No.: 11/744,285

(22) Filed: May 4, 2007

(65) Prior Publication Data

US 2008/0013931 A1 Jan. 17, 2008

Related U.S. Application Data

(60) Provisional application No. 60/797,815, filed on May 5, 2006.

(51) Int. Cl.
*B23K 1/005* (2006.01)

(52) U.S. Cl. ..... 392/410; 392/407

(58) Field of Classification Search ..... None
See application file for complete search history.

(56) References Cited

U.S. PATENT DOCUMENTS

| | | | |
|---|---|---|---|
| 1,867,740 | A | 7/1932 | Guy |
| 3,499,239 | A | 3/1970 | Mungo |
| 3,603,013 | A | 9/1971 | Reed et al. |
| 3,636,307 | A | 1/1972 | Pearce |
| 3,699,697 | A | 10/1972 | Painton |
| 3,978,598 | A | 9/1976 | Rose et al. |
| 4,573,905 | A | 3/1986 | Meyers |
| 4,890,600 | A | 1/1990 | Meyers |
| 5,195,820 | A | 3/1993 | Rehberg |
| 5,311,686 | A | 5/1994 | Christensen |
| 5,839,427 | A | 11/1998 | Shorts |
| 5,924,784 | A | 7/1999 | Chliwnyj et al. |
| 6,050,011 | A | 4/2000 | Hess et al. |
| 6,053,165 | A | 4/2000 | Butler et al. |
| 6,162,047 | A | 12/2000 | Hess |
| 6,340,868 | B1 | 1/2002 | Lys et al. |
| 6,350,498 | B1 | 2/2002 | Hess et al. |
| 6,385,881 | B1 | 5/2002 | Hess |
| 6,393,207 | B1 | 5/2002 | Martin et al. |
| 6,413,079 | B1 | 7/2002 | Lyons et al. |
| 6,564,485 | B1 | 5/2003 | Hess |
| 6,615,519 | B2 | 9/2003 | Hess |
| 6,672,860 | B2 | 1/2004 | Bachinski |

(Continued)

FOREIGN PATENT DOCUMENTS

| | | |
|---|---|---|
| CA | 920111 | 1/1973 |

(Continued)

*Primary Examiner*—Thor S Campbell
(74) *Attorney, Agent, or Firm*—James David Johnson

(57) ABSTRACT

An electric fireplace includes a fireplace housing having a housing first and second side walls and a housing top wall, a housing floor, a housing back wall, and a housing open end opposite the housing back wall; a flame simulator mounted inside the housing; a diffusion screen removably mounted upright within the housing in front of the flame simulator; an ember bed simulating the appearance of fireplace fuel such as fire wood, embers or coal, and removably mounted inside the housing in front of the flame simulator, so that removal of the ember bed and the flame cutout panel provides access to the flame simulator from the housing open end; and a hot air generator removably mounted inside the housing to be accessible from the housing open end.

20 Claims, 10 Drawing Sheets

U.S. PATENT DOCUMENTS

| | | | |
|---|---|---|---|
| 6,691,440 | B1 | 2/2004 | Petz et al. |
| 6,718,665 | B2 | 4/2004 | Hess et al. |
| 6,736,133 | B2 | 5/2004 | Bachinski et al. |
| 6,757,487 | B2 | 6/2004 | Martin et al. |
| 6,792,319 | B1 | 9/2004 | Bilger |
| 6,880,275 | B2 | 4/2005 | Mix et al. |
| 6,944,982 | B2 | 9/2005 | Schroeter et al. |
| 7,111,421 | B2 | 9/2006 | Corry et al. |
| 7,134,229 | B2 | 11/2006 | Hess et al. |
| 7,162,820 | B2 | 1/2007 | Hess et al. |
| 7,210,256 | B2 | 5/2007 | Rosserot |
| 7,219,456 | B1 | 5/2007 | Wei et al. |
| 7,236,693 | B2 | 6/2007 | Haugom |
| 2002/0139021 | A1 | 10/2002 | Hess et al. |
| 2002/0152655 | A1 | 10/2002 | Merrill et al. |
| 2002/0166554 | A1 | 11/2002 | Berg |
| 2002/0174579 | A1 | 11/2002 | Corry |
| 2003/0041491 | A1 | 3/2003 | Mix |
| 2003/0046837 | A1 | 3/2003 | Hess |
| 2003/0049024 | A1 | 3/2003 | Chen |
| 2003/0156828 | A1 | 8/2003 | Jamieson et al. |
| 2003/0201957 | A1 | 10/2003 | Mix et al. |
| 2004/0173202 | A1 | 9/2004 | Lyons et al. |
| 2004/0181989 | A1 | 9/2004 | Miller |
| 2004/0255931 | A1 | 12/2004 | Bachinski et al. |
| 2004/0264949 | A1 | 12/2004 | Deng |
| 2005/0066960 | A1 | 3/2005 | Harp |
| 2005/0086841 | A1 | 4/2005 | Schroeter et al. |
| 2005/0090915 | A1 | 4/2005 | Geiwitz |
| 2005/0097792 | A1 | 5/2005 | Naden |
| 2005/0155262 | A1 | 7/2005 | Mix et al. |
| 2005/0252051 | A1 | 11/2005 | Chen |
| 2006/0101681 | A1 | 5/2006 | Hess et al. |
| 2006/0150966 | A1 | 7/2006 | Jamieson |
| 2006/0153547 | A1 | 7/2006 | O'Neill |
| 2006/0185664 | A1 | 8/2006 | Butler |
| 2006/0188831 | A1 | 8/2006 | McDonald |
| 2006/0191529 | A1 | 8/2006 | McDonald |
| 2006/0213097 | A1 | 9/2006 | Haugom |
| 2006/0242870 | A1 | 11/2006 | Atemboski et al. |
| 2007/0094903 | A1 | 5/2007 | Hess et al. |
| 2007/0125367 | A1 | 6/2007 | Lim et al. |
| 2007/0224561 | A1 | 9/2007 | Hess et al. |

FOREIGN PATENT DOCUMENTS

| | | |
|---|---|---|
| CA | 1030833 | 5/1978 |
| CA | 1055796 | 6/1979 |
| CA | 1065221 | 10/1979 |
| CA | 1068736 | 12/1979 |
| CA | 1110940 | 10/1981 |
| CA | 1125127 | 6/1982 |
| CA | 1225427 | 8/1987 |
| CA | 2009379 | 8/1990 |
| CA | 1290208 | 10/1991 |
| CA | 2108300 | 4/1995 |
| CA | 2188244 | 4/1998 |
| CA | 2291014 | 12/1998 |
| CA | 2227951 | 7/1999 |
| CA | 2259866 | 7/1999 |
| CA | 2356146 | 7/1999 |
| CA | 2252213 | 4/2000 |
| CA | 2299816 | 9/2000 |
| CA | 2313972 | 1/2001 |
| CA | 2406557 | 4/2003 |
| CA | 2428411 | 7/2004 |
| CA | 2459898 | 9/2004 |
| CA | 2562462 | 10/2004 |
| CA | 2475527 | 1/2005 |
| CA | 2470739 | 2/2005 |
| CA | 2459788 | 5/2005 |
| CA | 2488243 | 8/2005 |
| CA | 2459849 | 9/2005 |
| CA | 2500939 | 9/2005 |
| CA | 2511081 | 1/2006 |
| CA | 2579444 | 3/2006 |
| CA | 2579778 | 3/2006 |
| CA | 2526747 | 5/2006 |
| CA | 2528761 | 6/2006 |
| CA | 2531304 | 7/2006 |
| CA | 2597577 | 8/2006 |
| CA | 25611220 | 3/2007 |
| EP | 1225389 | 7/2002 |
| EP | 1703211 | 9/2006 |
| GB | 2372805 | 9/2002 |
| GB | 2391614 | 2/2004 |
| GB | 2430487 | 3/2007 |
| WO | 8404018 | 10/1984 |
| WO | 0057109 | 9/2000 |
| WO | 2005028962 | 3/2005 |
| WO | 2006040167 | 4/2006 |
| WO | 2007069143 | 6/2007 |

ELECTRIC FIREPLACE

CROSS-REFERENCE TO RELATED APPLICATIONS

The present application claims the priority of U.S. provisional application No. 60/797,815 filed on May 5, 2006.

FIELD OF THE INVENTION

The present invention relates generally to the field of electric fireplaces. More specifically the present invention relates to an electric fireplace constructed so that operational components can be easily accessed, removed or replaced from the front of the fireplace rather than from the rear for convenient servicing and replacement, and permitting the fireplace to be permanently built into a building wall.

BACKGROUND

Electric fireplaces having the structural appearance of a conventional fireplace and containing mechanisms for simulating the appearance of a fire and producing heat electrically have been gaining popularity over the last several years. Conventionally, electric fireplaces are constructed so that operational components such as flame simulators and hot air generators can be serviced or repaired only from behind. As a result, such fireplaces cannot be mounted permanently in a building wall without creating significant servicing difficulties.

SUMMARY OF THE INVENTION

The invention is based on the development of an electric fireplace which is constructed so that operational components can be easily removed and replaced from the front rather than from the rear for convenient servicing and replacement, and permitting the fireplace to be permanently built into a building wall.

Accordingly, the invention features an electric fireplace for permanent installation in a recess in a building wall or other structure. The electric fireplace includes a fireplace housing having an interior defined by a housing first side wall, a housing second side wall, a housing top wall, a housing floor, a housing back wall, and a housing open end opposite said housing back wall; and one or more serviceable electric fireplace components positioned in the housing. The serviceable electric fireplace component can be a flame simulator or a hot air generator and includes at least one adjustable or replaceable part (e.g., a light bulb from the flame simulator or a heating element or blower motor from the hot air generator). When the fireplace is permanently installed in a recess in the building wall or other structure, the adjustable or replaceable part is accessible (e.g., visually and physically) by a person through the housing open end of the electric fireplace.

The electric fireplace can further include an artificial ember bed that resembles the appearance of real combustible fireplace fuel. The ember bed is located in the interior of the housing interposed between the flame simulator and the housing open end, and is reversibly attached to the housing such that a person can remove the ember bed from the interior of the housing to provide access to the adjustable or replaceable part. For esthetic reasons, at least a portion of the ember bed can have a finish that resembles the appearance of real combustible fireplace fuel, and the ember bed can be reversibly attached to the housing via at least one fastener also having a finish that resembles the appearance of real combustible fireplace fuel.

The electric fireplace can have an access panel pivotally fastened to the housing with the hot air generator mounted to one side of the access panel. The access panel together with the mounted hot air generator can be moved between a closed position wherein the at least one adjustable or replaceable part of the hot air generator is not directly accessible to a person through the housing open end of the electric fireplace and an open position wherein the at least one adjustable or replaceable part of the hot air generator is directly accessible to a person through the housing open end of the electric fireplace. The fireplace can include a lock for securing the access panel together with the mounted hot air generator in the closed position.

The electric fireplace can also include one or more cosmetic panels (e.g., one having a finish resembling brick or stone) affixed to the housing first side wall, the housing second side wall, the housing top wall, the housing floor, and/or the housing back wall. The cosmetic panels can include a magnetic fastener for reversibly mounting the panel to one of the walls.

In another aspect, the invention features a method of servicing a component of an electric fireplace permanently installed in a recess in a building wall and including a fireplace housing having an interior defined by a housing first side wall, a housing second side wall, a housing top wall, a housing floor, a housing back wall, and a housing open end opposite said housing back wall; and a serviceable electric fireplace component positioned in the housing and including at least one adjustable or replaceable part. This method includes the steps of: accessing the component through the front housing opening of the fireplace; and adjusting or replacing the at least one adjustable or replaceable part. The serviceable electric fireplace component can be a flame simulator or a hot air generator, and the adjustable or replaceable part can be a light bulb or a heating element.

Unless otherwise defined, all technical and legal terms used herein have the same meaning as commonly understood by one of ordinary skill in the art to which this invention belongs. As used herein in the context of a component in a fireplace, the phrase "visually accessible" means that the line of sight between the component to be serviced and a person looking into the front opening of the fireplace is not blocked by any part of the fireplace not intended to be repositioned to allow the component to be serviced. Also as used herein in the context of a component in a fireplace, the phrase "physically accessible" means that an average size person can reach his or her hand to the component through the front opening of the fireplace and service or replace the component without being blocked by any part of the fireplace not intended to be repositioned to allow the component to be serviced.

All publications, patent applications, patents, and other references mentioned herein are incorporated by reference in their entirety. In the case of conflict, the present specification, including definitions will control. Although apparatuses and methods similar or equivalent to those described herein can be used in the practice of the present invention, suitable apparatuses and methods are described below. In addition, the particular embodiments discussed below are illustrative only and not intended to be limiting. Other features and advantages of the invention will be apparent from the following detailed description, and from the claims.

DETAILED DESCRIPTION

Figure 1:
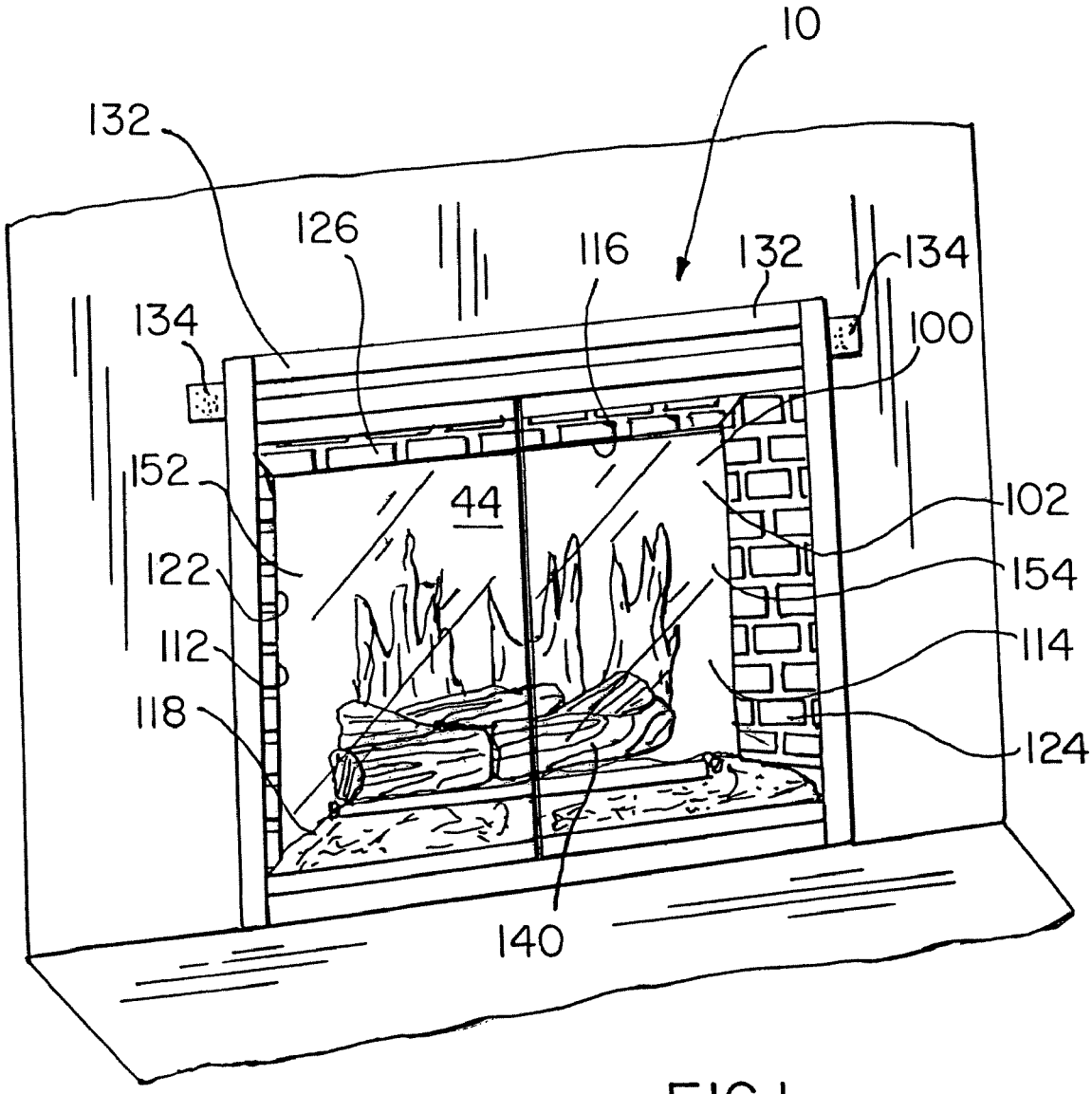
FIG. 1 is a perspective view of an exemplary embodiment of an electric fireplace installed in a wall.
Figure 2:
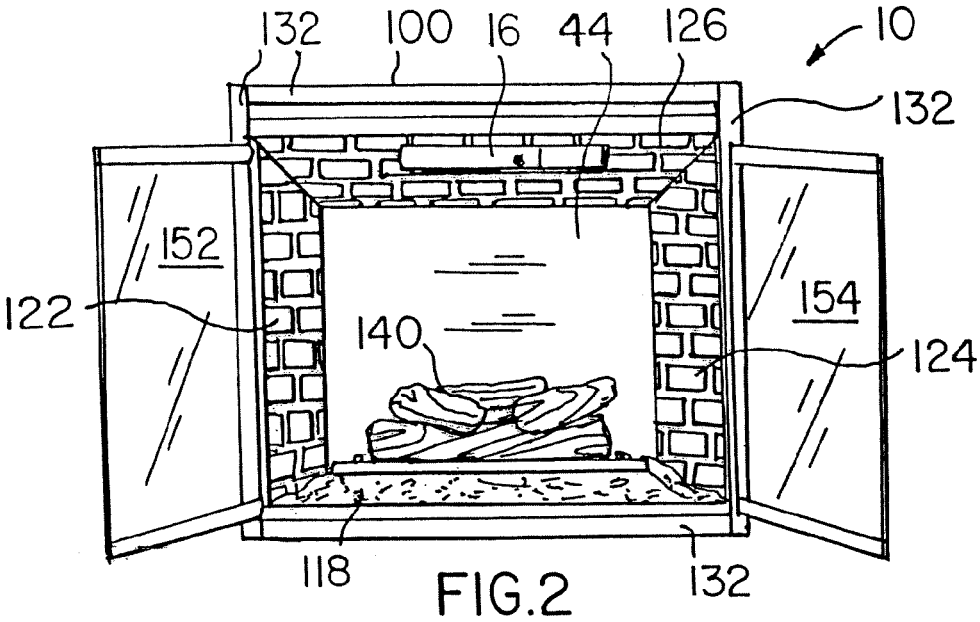
FIG. 2 is a front view of the fireplace of FIG. 1 with the first and second housing doors open.

Referring to FIGS. 1-12, an exemplary embodiment of an electric fireplace 10 includes a metal fireplace housing 100 having a housing open end 102, housing first and second side walls 112 and 114, a housing top wall 116, a housing floor 118 and a housing back wall 120. In FIG. 1, the metal fireplace housing 100 is shown permanently mounted within a recess in a building wall. A removable flame simulator 20 and a removable hot air generator 60 are both mounted inside the housing 100 and are framed by removably fastened cosmetic panels 122, 124, 126. The cosmetic panels have a brick finish and include first and second side panels 122 and 124 and a brick top panel 126 and preferably are fastened to the housing 100 and to these structures with magnetic fasteners 128 for removal without tools.

An ember bed 140 is removably fastened to the housing floor 118 in front of the flame simulator 20, and can be removed to gain access to the flame simulator 20. The ember bed 140 can take the form of any structure shaped and pigmented to simulate combustible fireplace fuel such as burning logs, wood fragments, embers or pieces of coal. The ember bed 140 is a hollow poly-resin, single-piece replica of burning logs. The ember bed 140 is secured with upright ember bed screws 142 which are welded to the housing floor 118 and pass through screw ports in the ember bed 140. Ember bed nuts 144 are screwed onto the upper ends of the ember bed screws 142 and have ember bed 140 matching resin faux wood nut covers which can be gripped to rotate the nuts 144 by hand. A simulated iron grate 146 preferably is provided as to further simulate the appearance of a conventional fire place.

The housing 100 is box-shaped with a peripheral mounting flange 134 extending laterally beyond a decorative trim 132 extending perpendicularly outwardly from the housing first and second side walls 112 and 114, housing top wall 116, and housing floor 118 at the housing open end 102. Four fastener tabs extend further outwardly from the peripheral mounting flange 134 and have tab fastener ports through which screws pass into the mantle structure or building wall. Translucent first and second housing doors 152 and 154 are hingedly connected respectively to the first and second housing side walls 112 and 114 at the housing open end 102. Behind the first and second housing doors 152 and 154, first and second mesh curtains can be slidably mounted to a curtain rod connected to the first and second housing side walls 112 and 114 and extending across the top of the housing open end 102. First and second plexi-glass brackets are provided on opposing sides of the housing 100 interior.

The flame simulator 20 includes a reflector plate shaft 22 rotatably mounted at each shaft 22 end on shaft bearing structures 24 and 26 and having elongate reflector plates 30 extending radially from the reflector plate shaft 22 in rotationally staggered relation. A shaft rotation motor 32 is drivably connected to one end of the reflector plate shaft 22 and is electrically connected to a fireplace circuit board 12, which in turn is connected to a fireplace junction box wired to a building power circuit and operated through a control panel 16 mounted to the housing top wall 116 in front of the housing top panel 126. The fireplace circuit board 12 and fireplace junction box are mounted in the fireplace housing 100. Reflector lights (e.g., light bulbs) 34 are mounted to the housing floor 118 forwardly of the reflector plate shaft 22 and radiate light toward the reflector plates 30 so that the reflector plates 30 scatter the light in a way simulating the flickering of a fire as they rotate on the reflector plate shaft 22. A flame cutout panel 40 is removably mounted upright in front of the reflector plate shaft 22 and has cut-out regions 42 shaped to resemble flames so that light reflected by the reflector plates 30 passes through and takes the shapes of the cut-out regions 42. A frosted light diffusion screen 44 is provided in front of flame cutout panel 42.

The hot air generator 60 is mounted to an access panel middle section 80 hingedly fastened along the access panel rear edge 80*a* to the housing top wall 116 above the top panel 126. The access panel middle section 80 is bordered on opposing sides by contiguous first and second access panel peripheral sections 82 and 84, respectively. Each of the first and second access panel peripheral sections 82 and 84 includes a panel latching mechanism 90 which preferably includes an arched handle slot 86 in the given access panel peripheral section 82 or 84 through which a latch handle 92 protrudes downwardly, the latch handle 92 being connected to a pivoting latch arm pivotally mounted to a fulcrum rivet 94 on top of each access panel peripheral section 82 or 84, the latch arm free end being pivotally into an arm engaging structure mounted to the top surface of the access panel middle section 80.

The hot air generator 60 includes a blower 62 having a blower motor 64 mounted in a blower housing 66 having a forwardly opening blower air exit slot and includes an air flow guide box 72 mounted adjacent to and in front of the blower housing air exit slot. The top panel 126 pivots down to provide access to the hot air generator 60. The blower motor 64 is electrically connected to the fireplace circuit board 12. The air flow guide box 72 has a rear guide box air entry slot and a front guide box air exit slot and electric heating elements 74 passing laterally through the air flow guide box 72, the heating elements 74 being electrically connected to the fireplace circuit board 12.

Figure 3:
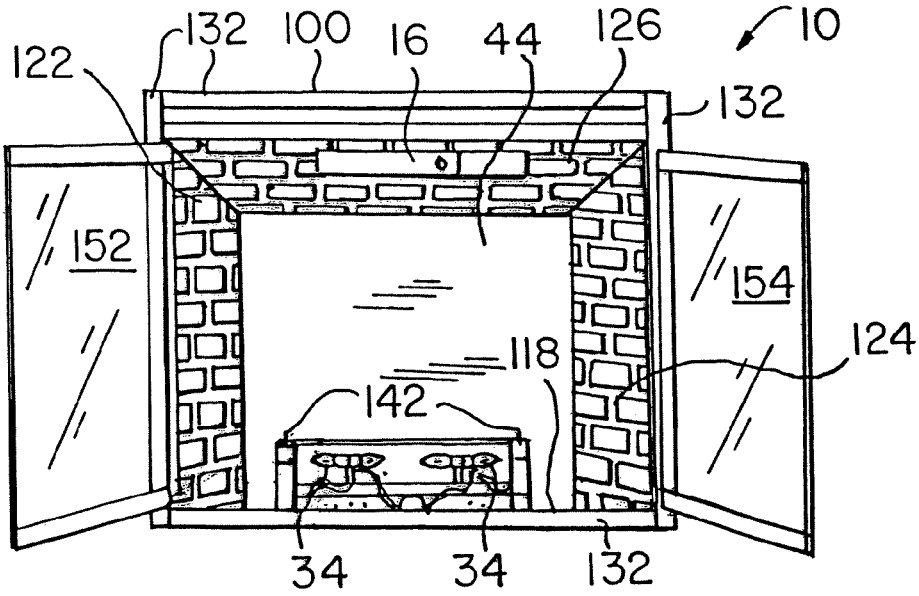
FIG. 3 is a front view as in FIG. 2 with the ember bed removed to expose the reflector lights and ember bed screws, representing a first stage of disassembly for servicing.
Figure 4:
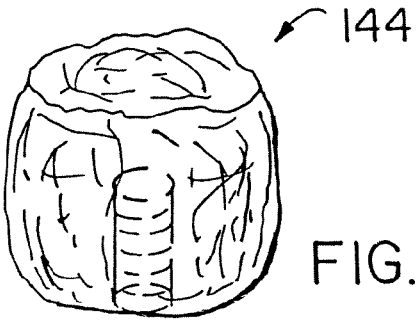
FIG. 4 is a close-up perspective view of an ember bed nut.
Figure 5:
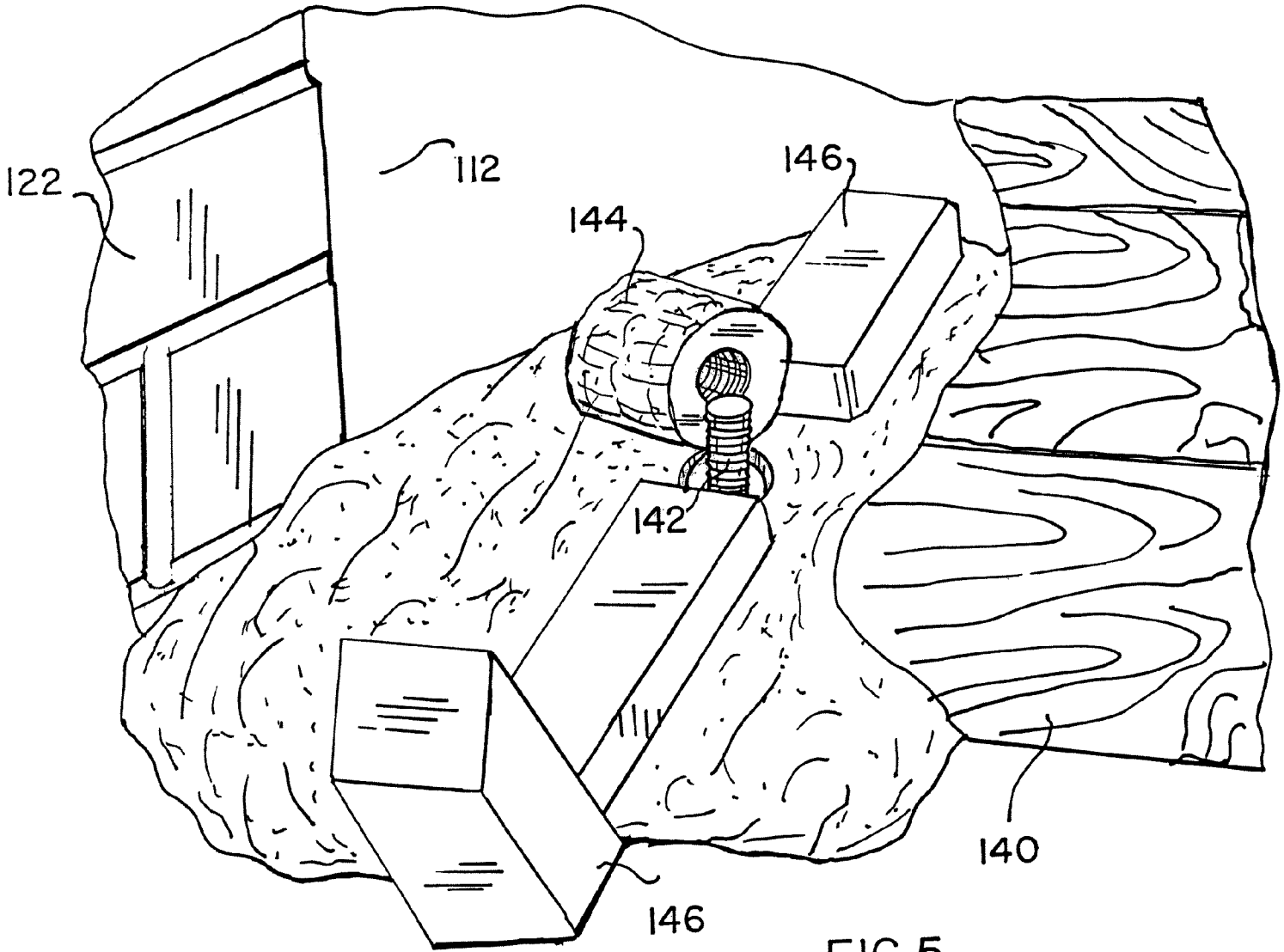
FIG. 5 is a close-up, broken away, perspective view of the ember bed and an ember screw protruding upwardly through a port in the ember bed and an ember bed nut resting on its side adjacent to the ember bed screw, and showing part of a side panel and a simulated iron grate.
Figure 5A:
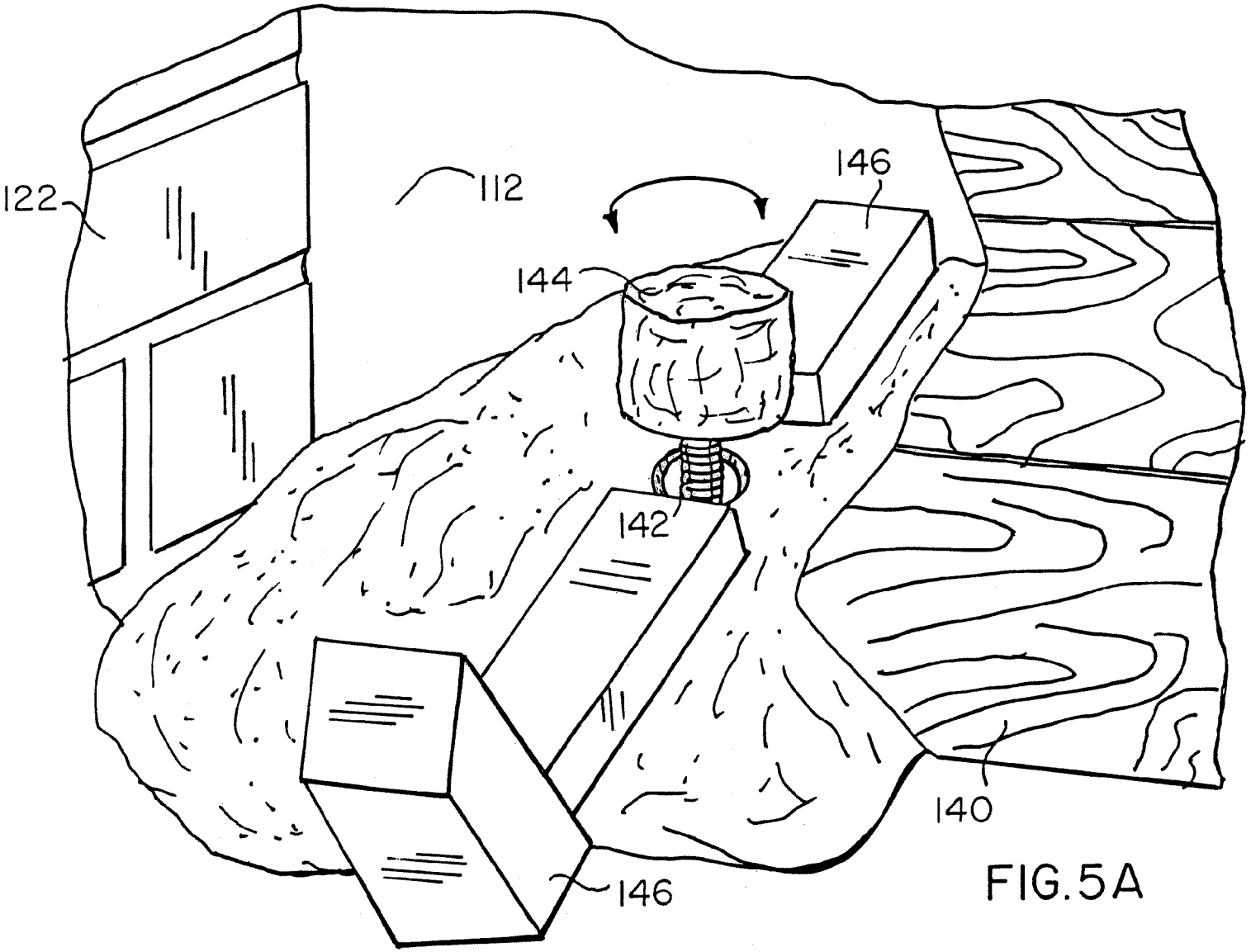
FIG. 5A is a view as in FIG. 5, except that the ember bed nut is partially screwed onto the ember bed screw.
Figure 6:
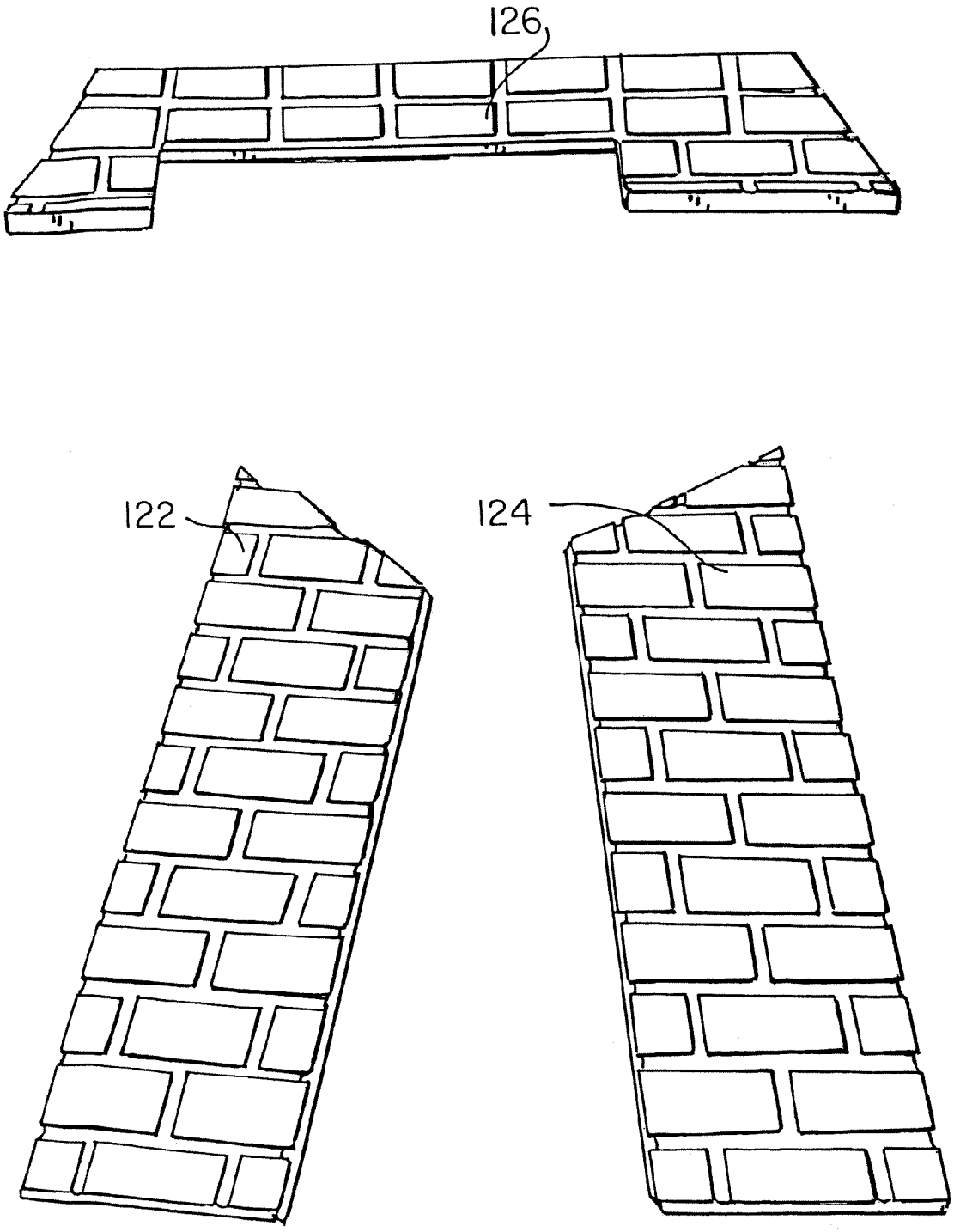
FIG. 6 is a perspective view of the first and second side cosmetic panels and the top cosmetic panel showing their brick textured front faces.
Figure 7:
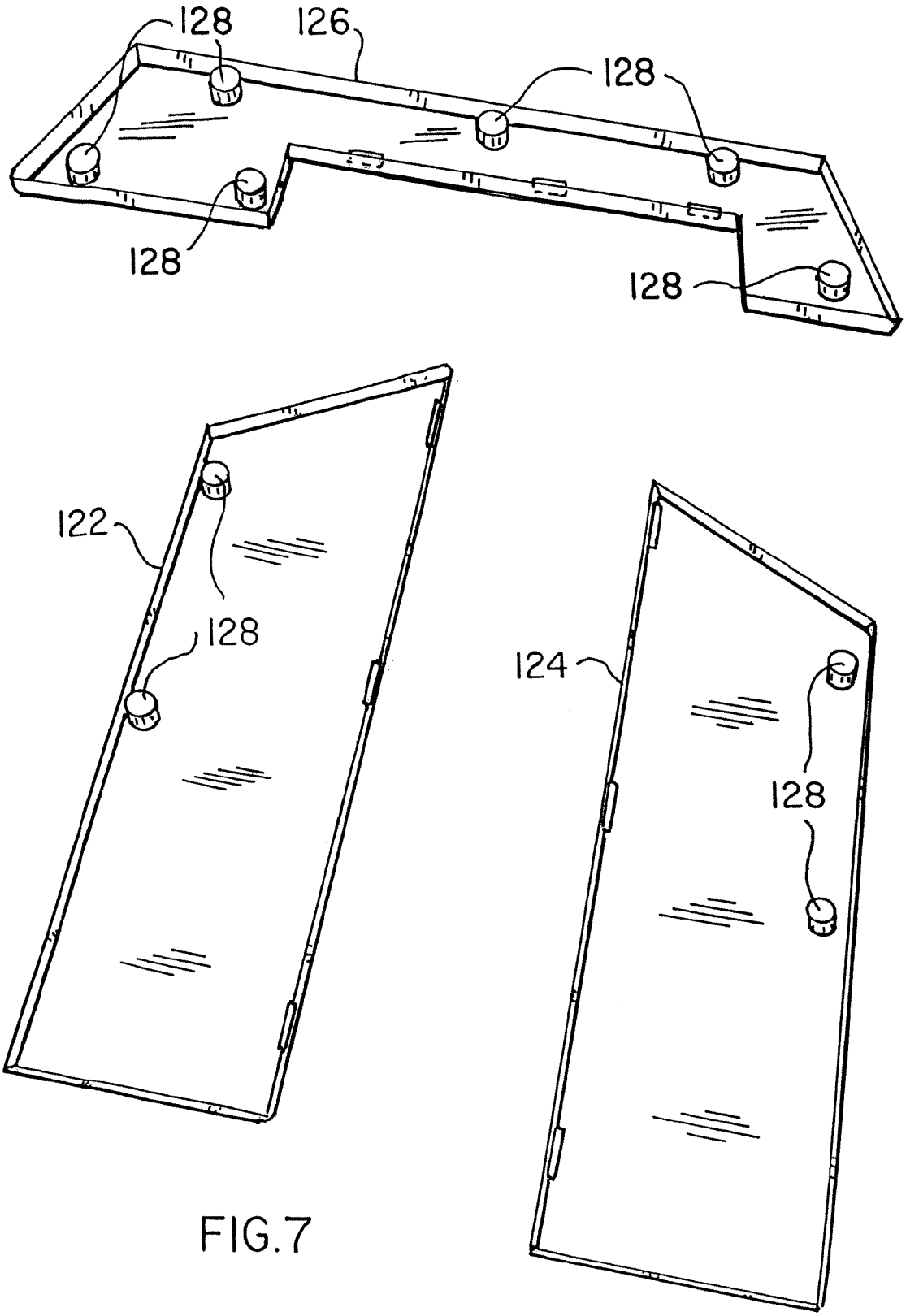
FIG. 7 is a perspective view as in FIG. 6 except that the rear faces of the first and second side panels and of the top panel are shown, revealing the preferred magnetic fasteners.
Figure 8:
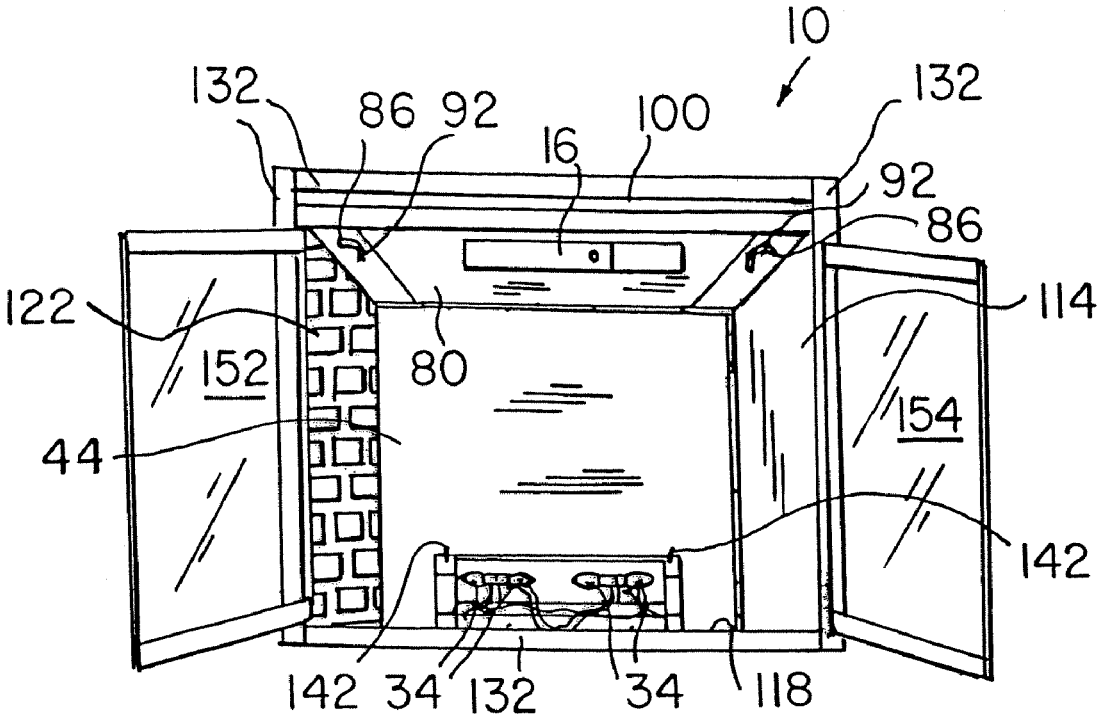
FIG. 8 is a front view of the fireplace of FIG. 3, with the second side panel removed.
Figure 9:
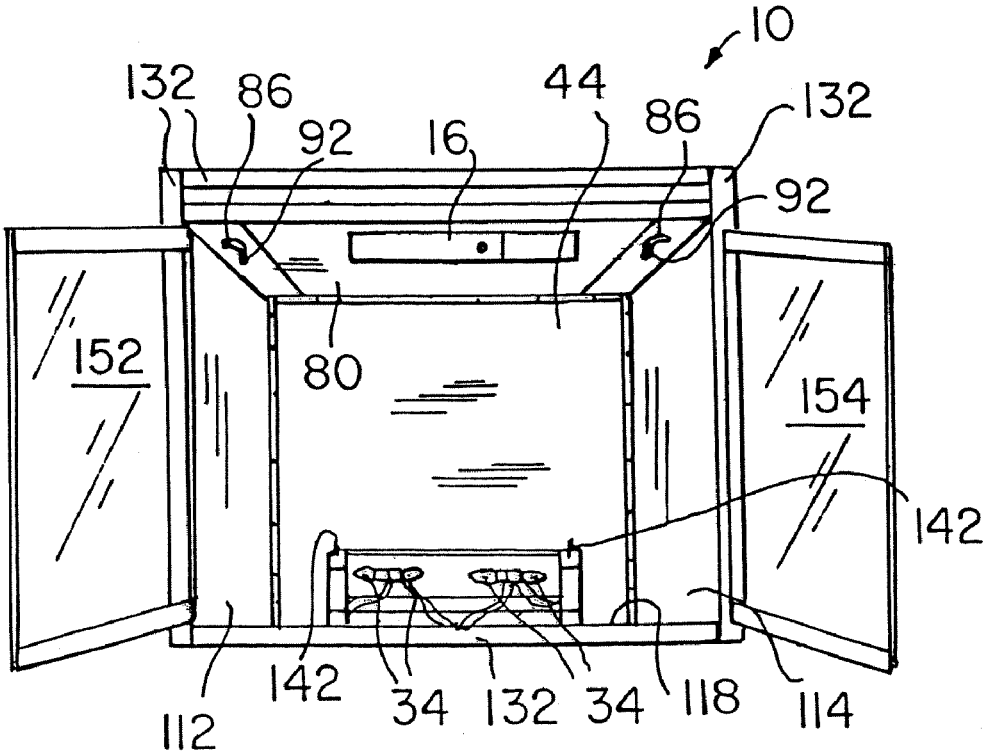
FIG. 9 is a view as in FIG. 8 with both the first and second panels removed.
Figure 12:
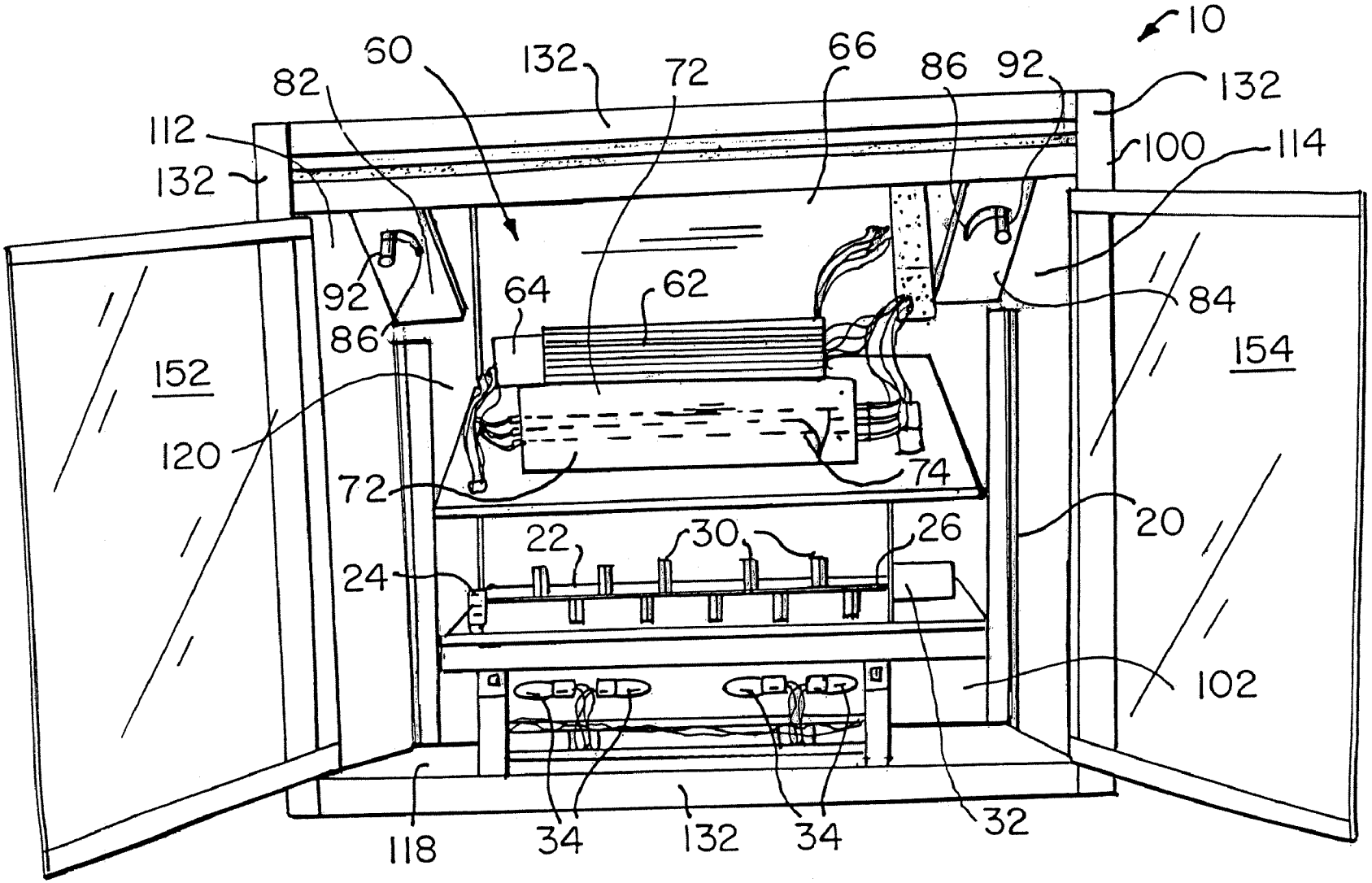
FIG. 12 is a front view as in FIG. 11 with the reflector plate shaft of the flame simulator revealed by removal of the flame cutout panel.

Serviceable components within the electric fireplace can be accessed by a person reaching through the housing open end 102. Referring to FIGS. 2-5*a,* to access a part of the flame simulator 20 such as one of the reflector lights 34, the ember bed 140 is first removed from the housing 100 by unscrewing the ember bed nuts 144 from the ember bed screws 142, and removing the ember bed 140 through the housing open end 102. As shown in FIGS. 3 and 12, removal of the ember bed 140 in this manner exposes the reflector lights 34 as well as other components of the flame simulator 20 for easy replacement or adjustment by a technician. After the reflector lights 34 or other components of the flame simulator 20 are replaced, adjusted or otherwise serviced, the foregoing steps are reversed so that the flame simulator 20 is once again in a hidden position.

Figure 10:
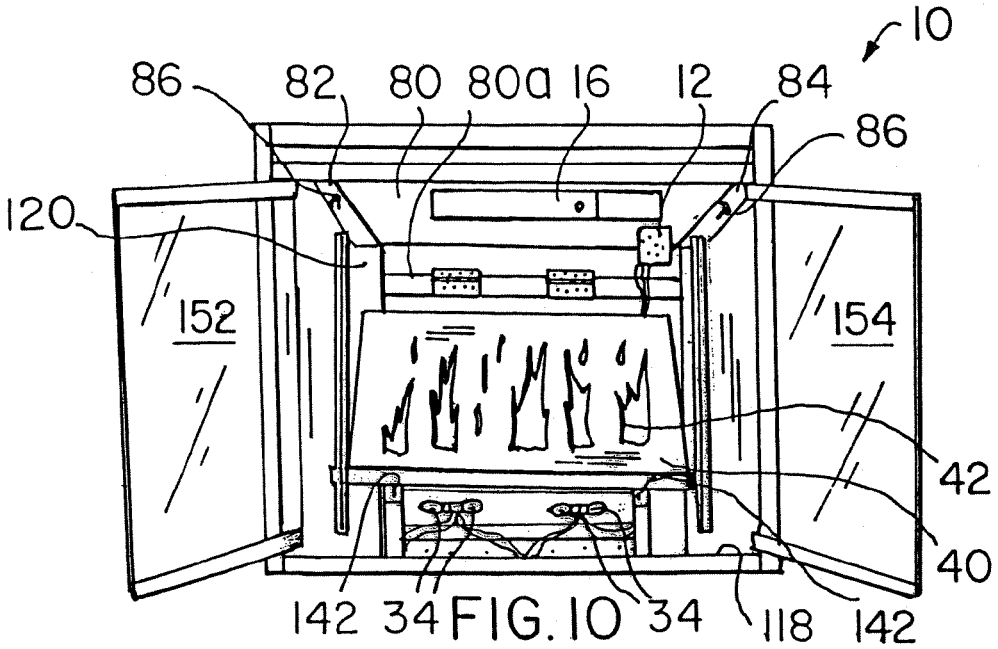
FIG. 10 is a view as in FIG. 9 with the frosted diffusion screen removed, revealing the flame cutout panel and the access panel sections.
Figure 11:
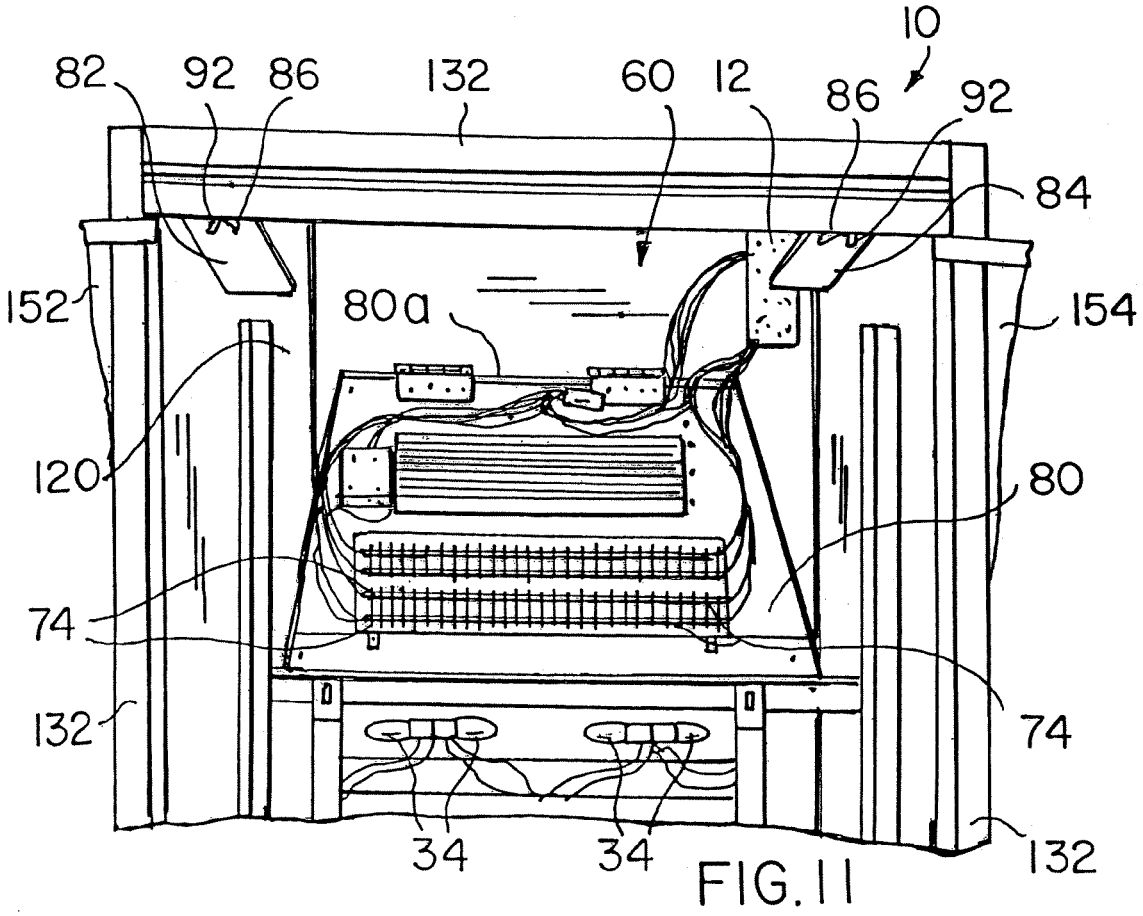
FIG. 11 is a view as in FIG. 10 with the access panel middle section pivoted down to reveal the hot air generator.
Figure 11A:
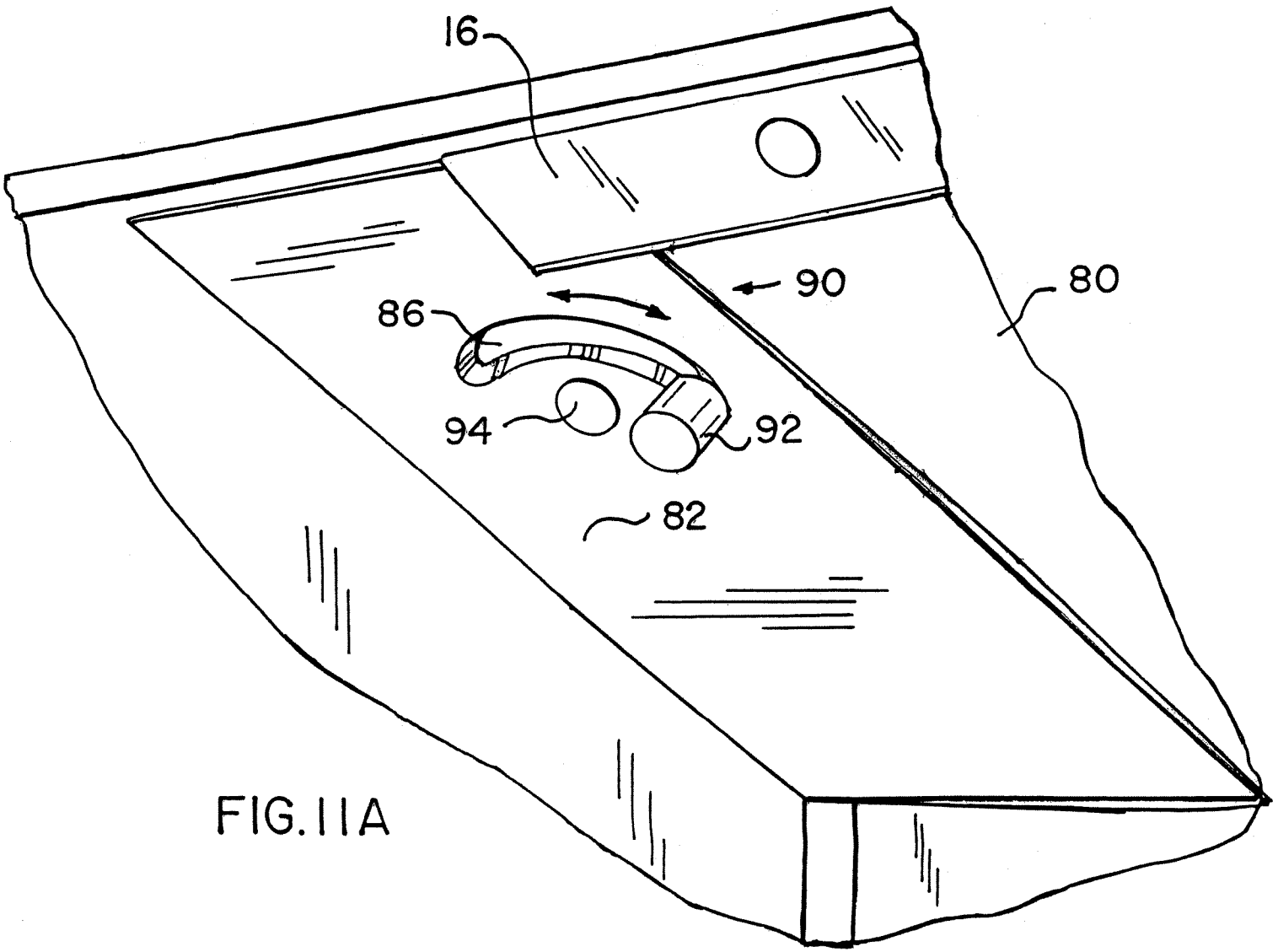
FIG. 11*a* is a close-up, broken away view of an access panel middle section, and of an adjacent and contiguous access panel lateral section having the arched handle slot and latch handle of the preferred panel latching mechanism.

Referring to FIGS. 10-12, to access a part of the hot air generator 60 such as one of the heating elements 74, the latch handle 92 of the panel latching mechanism 90 is placed on a position that allows the access panel middle section 80 with attached hot air generator 60 to swing down to an open position (FIGS. 11 and 12) so that the heating elements 74 and other components of the hot air generator 60 are exposed for easy replacement or adjustment by a technician. Once the heating elements 74 and/or other components of the hot air generator 60 are replaced, adjusted or otherwise serviced, the foregoing steps are reversed so that the hot air generator 60 is once again in a closed position (FIGS. 1 and 10).

OTHER EMBODIMENTS

It is to be understood that while the invention has been described in conjunction with the detailed description thereof, the foregoing description is intended to illustrate and not limit the scope of the invention, which is defined by the scope of the appended claims. The size, materials, color, etc. of the components of the lighting system can vary. Other aspects, advantages, and modifications are within the scope of the following claims.

What is claimed is:

1. An electric fireplace comprising:

a fireplace housing having an interior by a housing first side wall, a housing second side wall, a housing top wall, a housing floor, a housing back wall, and a housing open end opposite said housing back wall; and a serviceable electric fireplace component positioned in the housing, the serviceable electric fireplace component comprising at least one adjustable or replaceable part, wherein, when the fireplace is installed in or against a building wall or other structure, the at least one adjustable or replaceable part is physically accessible by a person through the housing open end of the electric fireplace, and wherein the serviceable electric fireplace component is concealed by a part selected from the group consisting of: an access panel and a removable ember bed.

2. The electric fireplace of claim 1, wherein the serviceable electric fireplace component is a flame simulator.

3. The electric fireplace of claim 2, wherein the at least one adjustable or replaceable part is selected from the group consisting of a light bulb, a motor, and a circuit board.

4. The electric fireplace of claim 1, wherein the serviceable electric fireplace component is a hot air generator.

5. The electric fireplace of claim 4, wherein the at least one adjustable or replaceable part is a heating element.

6. The electric fireplace of claim 4, wherein the at least one adjustable or replaceable part is a blower motor.

7. The electric fireplace of claim 2 further comprising the artificial ember bed that resembles the appearance of real combustible fireplace fuel, the ember bed being located in the interior of the housing interposed between the flame simulator and the housing open end, wherein the ember bed is reversibly attached to the housing such that a person can remove the ember bed from the interior of the housing to provide access to the at least one adjustable or replaceable part.

8. The electric fireplace of claim 7, wherein at least a portion of the ember bed has a finish that resembles the appearance of real combustible fireplace fuel, and the ember bed is reversibly attached to the housing via at least one fastener, the fastener having at least one portion having a finish that resembles the appearance of real combustible fireplace fuel.

9. The electric fireplace of claim 4, wherein the housing has attached thereto the access panel pivotally fastened to the housing, the hot air generator is mounted to a side of the access panel, and the access panel together with the mounted hot air generator can be moved between a closed position wherein the at least one adjustable or replaceable part of the hot air generator is not directly accessible to a person through the housing open end of the electric fireplace and an open position wherein the at least one adjustable or replaceable part of the hot air generator is directly accessible to a person through the housing open end of the electric fireplace.

10. The electric fireplace of claim 9, wherein the fireplace further comprises a lock for securing the access panel together with the mounted hot air generator in the closed position.

11. The electric fireplace of claim 1, additionally comprising at least one cosmetic panel affixed to at least one wall selected from the group consisting of the housing first side wall, the housing second side wall, the housing top wall, the housing floor, and the housing back wall.

12. The electric fireplace of claim 11, wherein the at least one cosmetic panel comprises a finish resembling brick or stone.

13. The electric fireplace of claim 11, wherein the at least one cosmetic panel comprises at least one magnetic fastener for reversibly mounting the at least one cosmetic panel to at least one wall selected from the group consisting of the housing first side wall, the housing second side wall, the housing top wall, the housing floor, and the housing back wall.

14. An electric fireplace for permanent installation in a recess in a building wall or other structure, the electric fireplace comprising:

a fireplace housing having an interior defined by a housing first side wall, a housing second side wall, a housing top wall, a housing floor, a housing back wall, and a housing open end opposite said housing back wall;

a flame simulator positioned in the housing concealed from view by an ember bed; and a hot air generator positioned in the housing concealed from view by an access panel, wherein, when the fireplace is installed in or against a building wall or other structure, both the flame simulator and hot air generator are physically accessible by a person through the housing open end of the electric fireplace.

15. The electric fireplace of claim 1, additionally comprising at least one cosmetic panel affixed to at least one wall selected from the group consisting of the housing first side wall, the housing second side wall, the housing top wall, the housing floor, and the housing back wall.

16. The electric fireplace of claim 15, wherein the at least one cosmetic panel comprises a finish resembling brick or stone.

17. The electric fireplace of claim 15, wherein the at least one cosmetic panel comprises at least one magnetic fastener for reversibly mounting the at least one cosmetic panel to at least one wall selected from the group consisting of the housing first side wall, the housing second side wall, the housing top wall, the housing floor, and the housing back wall.

18. A method of servicing a component of an electric fireplace installed in or against a building wall or other structure and comprising a fireplace housing having an interior defined by a housing first side wall, a housing second side wall, a housing top wall, a housing floor, a housing back wall, and a housing open end opposite said housing back wall; and a serviceable electric fireplace component positioned in the housing, the serviceable electric fireplace component being selected from the group consisting of: a flame simulator and a hot air generator and comprising at least one adjustable or replaceable part, the method comprising the steps of:

visually and physically accessing the component through the front housing opening of the fireplace by movement of a part concealing the component, the part being selected from the group consisting of: an access panel and a removable ember bed; and adjusting or replacing the at least one adjustable or replaceable part.

19. The method of claim 18, wherein the serviceable electric fireplace component is a flame simulator, the at least one adjustable or replaceable part is selected from the group consisting of a light bulb, a motor, and a circuit board.

20. The method of claim 18, wherein the serviceable electric fireplace component is a hot air generator, the at least one adjustable or replaceable part is selected from the group consisting of a heating element and a blower.

* * * * *

UNITED STATES PATENT AND TRADEMARK OFFICE

CERTIFICATE OF CORRECTION

PATENT NO. : 7,826,727 B2
APPLICATION NO. : 11/744285
DATED : November 2, 2010
INVENTOR(S) : William Scott Bourne It is certified that error appears in the above-identified patent and that said Letters Patent is hereby corrected as shown below:

Column 5, line 46, insert the term --defined-- in between ..."interior" and "by" to read:

...a fireplace housing having an interior defined by a housing first side...

Signed and Sealed this
Eighteenth Day of January, 2011

David J. Kappos

David J. Kappos
*Director of the United States Patent and Trademark Office*